US005516224A

United States Patent [19]

Moshammer

[11] Patent Number: 5,516,224

[45] Date of Patent: May 14, 1996

[54] DEVICE FOR PLACING GLUE IN SLIT-SHAPED GROOVES IN A WORKPIECE

[75] Inventor: Horst Moshammer, Linz/Rhein, Germany

[73] Assignee: Wolfcraft GmbH, Weibern, Germany

[21] Appl. No.: 305,192

[22] Filed: Sep. 13, 1994

Related U.S. Application Data

[63] Continuation of Ser. No. 950,217, Sep. 24, 1992, abandoned.

[51] Int. Cl.[6] ..... B05C 11/00

[52] U.S. Cl. ..... 401/266; 401/261; 156/578; 425/87

[58] Field of Search ..... 401/266, 265, 401/262, 261, 9, 202, 10, 11; 156/578, 575; 425/87, 458; 144/353; 239/589, 597; 222/575

[56] References Cited

U.S. PATENT DOCUMENTS

| | | | |
|---|---|---|---|
| 943,231 | 12/1909 | Brooks | 401/266 X |
| 1,839,548 | 1/1932 | Gimonet | 401/266 X |
| 2,049,973 | 8/1936 | Nesmith | 401/261 |
| 2,065,298 | 12/1936 | Abbott | 401/266 X |
| 2,877,480 | 3/1959 | Warren | 401/9 |
| 3,352,623 | 11/1967 | Sanet | 401/10 |
| 4,074,655 | 2/1978 | Gross et al. | 401/261 X |
| 4,220,114 | 9/1980 | Radowicz | 156/578 |
| 4,516,591 | 5/1985 | Hierholzer | 401/265 X |
| 4,727,893 | 3/1988 | Goncalves | 401/265 X |
| 4,887,924 | 12/1989 | Green | 401/266 X |
| 5,119,838 | 6/1992 | Nakazima | 401/202 X |
| 5,143,572 | 9/1992 | Hatch | 156/293 |

FOREIGN PATENT DOCUMENTS

| | | |
|---|---|---|
| 337653 | 4/1959 | Switzerland . |
| 339735 | 7/1959 | Switzerland . |

*Primary Examiner*—Robert A. Hafer
*Assistant Examiner*—Jeffrey D. Carlson
*Attorney, Agent, or Firm*—Antonelli, Terry, Stout & Kraus

[57] ABSTRACT

A device for applying glue to slit-shaped grooves in a workpiece, with the grooves serving to receive lamellar dowels. The device includes a glue supply container with a glue nozzle and, in order to permit an application of glue that is uniform and precisely metered throughout the groove, the glue nozzle has a flat mouthpiece insertable into the slit-shaped grooves, with the mouthpiece having a central glue passageway and being provided at its two wide sides with recesses in which the glue passageway terminates through lateral branches.

7 Claims, 4 Drawing Sheets

DEVICE FOR PLACING GLUE IN SLIT-SHAPED GROOVES IN A WORKPIECE

This is a continuation of application Ser. No. 950,217 filed Sep. 24, 1992 now abandoned.

FIELD OF THE INVENTION

The invention relates to a device for placing glue in slit-shaped grooves in a workpiece, with the grooves being suitably dimensioned for each to receive one lamellar dowel, with the device having a glue supply container provided with an outlet opening through which the glue is dispensed, and a glue nozzle, located on the glue supply container in a vicinity of the outlet opening.

BACKGROUND OF THE INVENTION

Swiss Patents 337,653 and 339,735 propose a method of connecting wooden panels, for example, using the principle of tongue and groove joints, wherein oppositely disposed groove slits, shaped as segments of a circle, are cut in the connecting surfaces of the panels, and lamellar dowels, in the form of small elliptical plates, are inserted as connecting elements. The small elliptical plates have external dimensions matching those of the narrow slit-shaped grooves.

When making such dowel connections, very uniform application of glue on the side walls and bottom of the groove is necessary in order to produce an optimum glued joint. The application of the glue must also be metered very precisely so that no excess glue escapes at the ends of the workpieces to be joined, forming globs of glue that considerably complicate a precise fitting together of the workpieces and would have an adverse affect on appearance.

Known glue devices usually consist of a tube or compressible bottle onto which a tapered spout is threadably mounted, so that the glue can only be applied in beads. Known glue devices for flush application of glue, for example, on paper, are not suitable for such grooves because they cannot be used, for example, to coat the bottom of the groove in the corner areas inside the groove. In addition, these glue devices are too large as a rule to be inserted into a lamellar groove.

SUMMARY OF THE INVENTION

The goal of the invention is to provide a device for applying glue to slit-shaped grooves in a workpiece, with the device permitting uniform application of glue to the bottom of the groove, the opposite flat sides of the groove, and corner areas located therebetween.

According to the invention, by virtue of the fact that the glue nozzle has a flat mouthpiece that has one narrow end and two parallel wide sides and is insertable into the slit-shaped groove, by the fact that the mouthpiece has a central glue passageway that opens at the end of the mouthpiece, by the fact that the mouthpiece is provided at its two wide sides with recesses each of which is open toward the end, and by the fact that the glue passageway is provided with branches terminating in the recesses, it is possible to achieve the goal of the invention.

The glue supply container preferably is fashioned of elastic plastic material and is manually compressible. A glue supply container of this kind largely prevents undesired continued flow when gluing. However, the glue supply container can also be a glue tube, made of metal, for example, or a cartridge from which glue is expressible by a spring-loaded bottom member. The glue nozzle, located in the vicinity of the outlet opening of the glue supply container, has a flat mouthpiece with a narrow end and two parallel wide sides. The two parallel wide sides have recesses open toward the end, with the recesses being connected with the glue passageway by branches. The glue passageway terminates in the end of the mouthpiece. This ensures that the glue can uniformly reach all walls of the groove and the corners located therebetween. The size of the recesses open toward the end thus determines the quantity of glue to be applied. The two parallel wide sides and the narrow ends also make it possible to apply the glue delivered to the groove uniformly within the groove.

According to the invention, the mouthpiece is provided at its end with a transverse groove open to the two recesses, in which groove the glue passageway terminates. This design of the branches ensures both an exact application of glue over the entire height of the narrow end and an especially good application of glue to the corner areas of the groove.

In a device for applying glue, provision can also be made according to the invention for the recesses to have a length and width such that they are completely insertable into the groove to be provided with glue and for the wide sides of the mouthpiece surrounding the recesses to be separated by a distance from one another that is equivalent to the width of the groove. In this embodiment, the volume of glue applied is determined by the size of the recesses and the gluing area is delimited from the opening of the groove. This ensures that no excess glue will be squeezed out of the groove during gluing and the ends of the workpieces to be joined will not be contaminated. Another construction of the invention provides that the end of the flat mouthpiece is designed lengthwise as a convex circular arc. The mouthpiece has the same shape as the groove, so that exact application of glue, both in terms of volume and glue application area, is ensured.

In a glue device according to the invention, provision can be made for the mouthpiece to be provided with a foot designed as a screw cap, with the foot being threadable onto a threaded connecting stub of the glue supply container, and with the foot preferably being sealed by a sealing lip that can be tightened against the threaded connecting stub. Threadable connections of this type have proven to be very reliable connections that can be frequently reused.

Additionally, the mouthpiece can have associated therewith a removable cap having a stub on an interior thereof that is insertable as a sealing element into the transverse groove and into the central glue passageway. A cap of this type ensures that no old glue residue adheres to the mouthpiece to adversely affect the useability of the glue device.

BRIEF DESCRIPTION OF THE DRAWINGS

The invention will now be described in greater detail with reference to the accompanying drawings, wherein.

DETAILED DESCRIPTION

Figure 1:
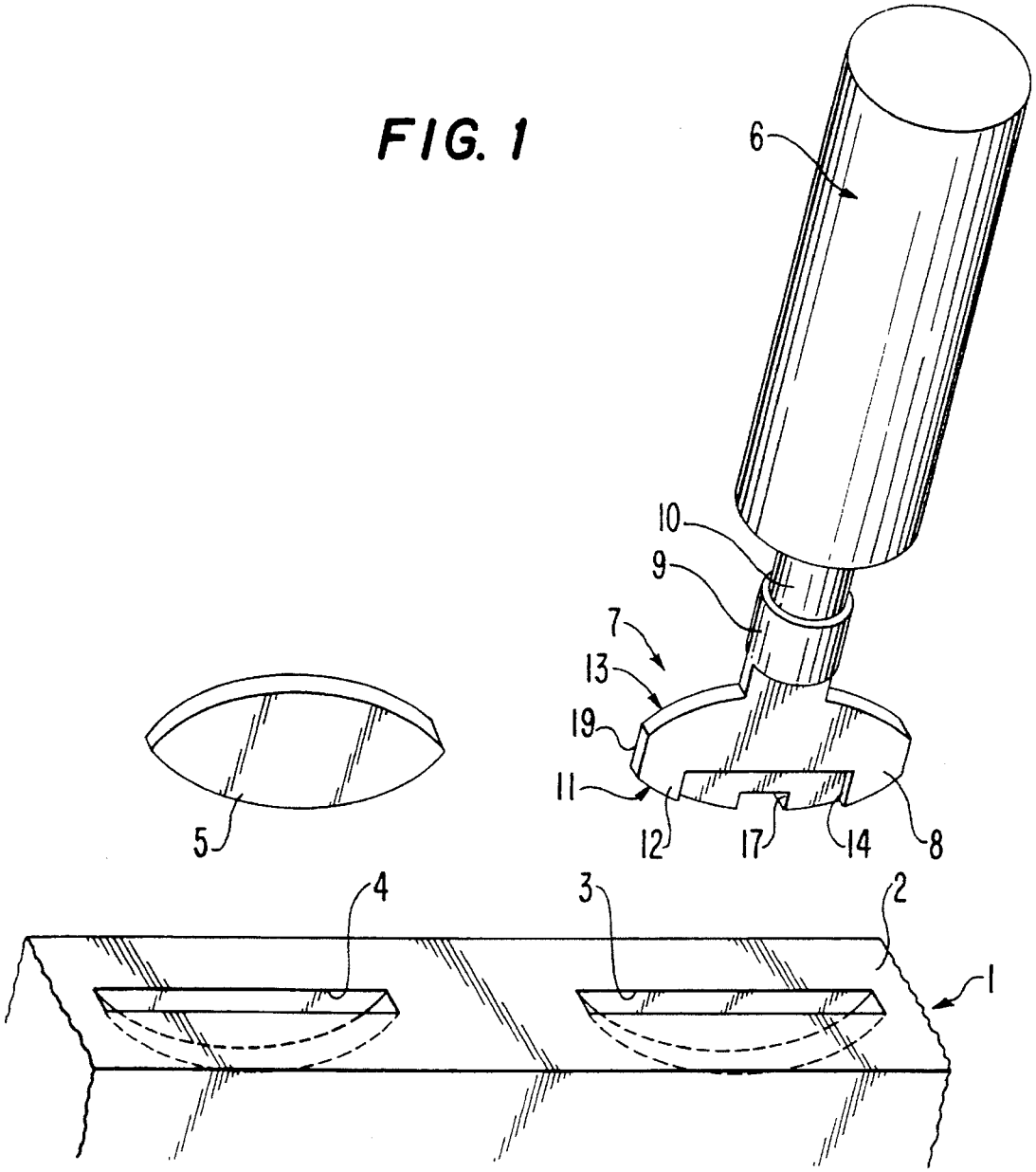
FIG. 1 is an exploded perspective view of a glue device according to the present invention, together with a workpiece to be doweled and a lamellar dowel.

Referring now to the drawings wherein like reference numerals are used throughout the various views to designate like parts and, more particularly, to FIG. 1, according to this figure, a workpiece generally designated by the reference numeral 1 includes slit-shaped grooves 3, 4 in an end area 2 thereof, with the grooves 3, 4 being dimensioned so as to allow a reception of a lamellar dowel 5. The lamellar dowels 5 generally have a length of 50 to 70 mm, and a width of 6–15 mm, with a thickness of 4–6 mm. The external shape of such a two-pointed dowel 5 is determined by arc segments joining the two corners together. It is them possible to fashion the grooves 3 and 4 by using disc-shaped milling cutters of a suitable diameter. The lamellar dowels are each inserted half way into the grooves 3 and 4 respectively of two workpieces to be joined together.

Figure 2:
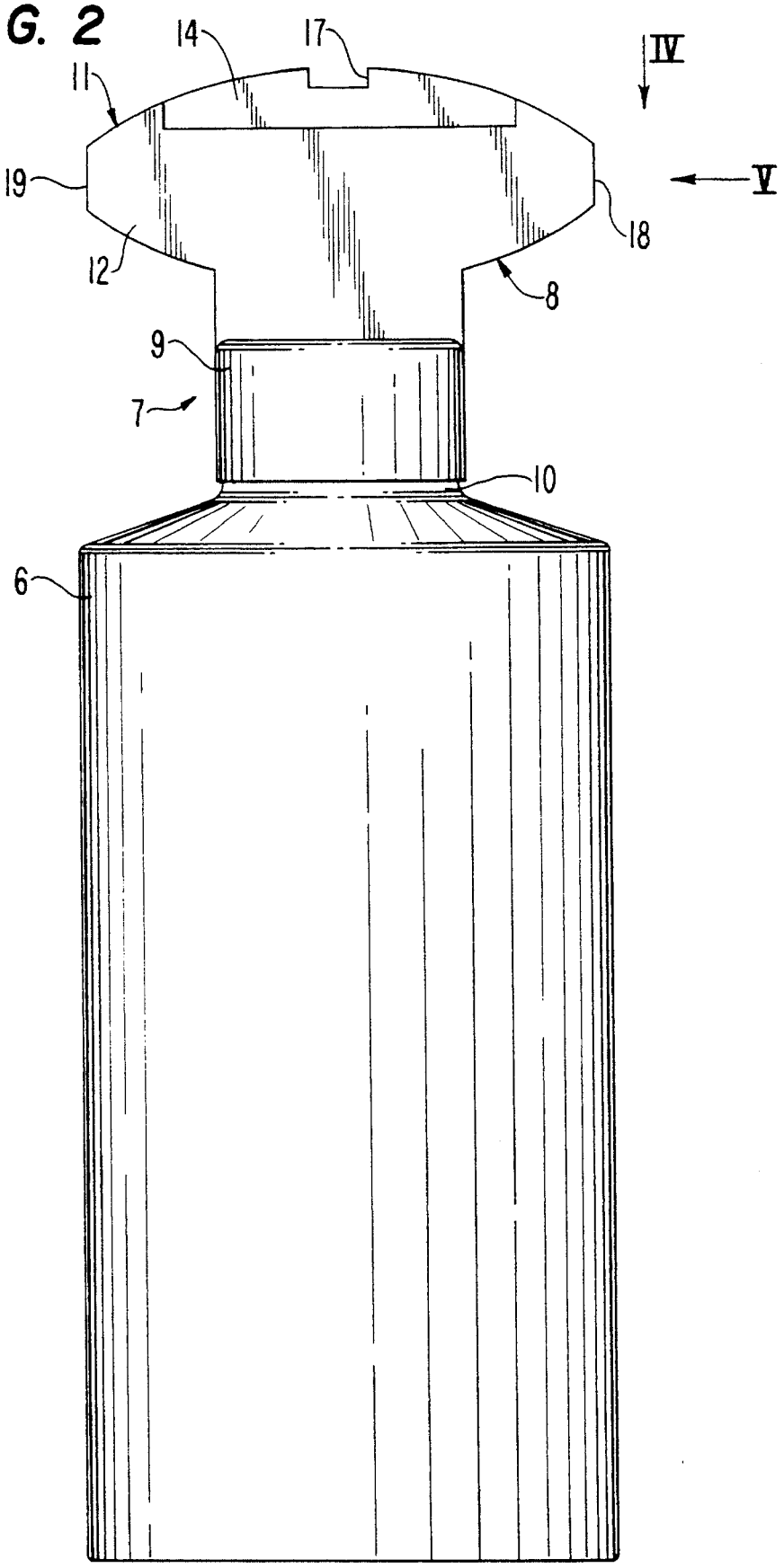
FIG. 2 is a side view of the glue device of FIG. 1.

The glue device as shown in FIG. 1 consists of a glue supply container 6 with a bottle shape with glue nozzle 7 mounted. A mouthpiece 8 of glue nozzle 7 is provided with a foot in the form of a screw cap 9 screwed onto a threaded connecting stub 10 of glue supply container 6; see also FIGS. 2–6. Mouthpiece 8 has a narrow end 11 and two parallel wide sides 12 and 13 and also has dimensions matching grooves 3 and 4. On the two parallel wide sides 12 and 13, recesses 14 and 15, each open to end 11, are provided, the recesses being connected with a central glue passageway 16 by branches in the form of a transverse groove 17. FIG. 2 illustrates mouthpiece 8 as shortened lengthwise relative to the lamellar dowel 5 and has two narrow sides 18 and 19 instead of the two points of lamellar dowel 5. Mouthpiece 8 is received by grooves 3 and 4 approximately up to the middle of these narrow sides 18 and 19. Thus, recesses 14 and 15 are such a length and width that they fit completely into grooves 3 and 4 to be provided with glue. Wide sides 12 and 13 in which recesses 14 and 15 are located are separated from one another by a distance corresponding to the width of grooves 3 and 4. For a clear fit to the bottom of the groove, end 11 of mouthpiece 8 is made as a lengthwise convex circular arc.

Figure 3:
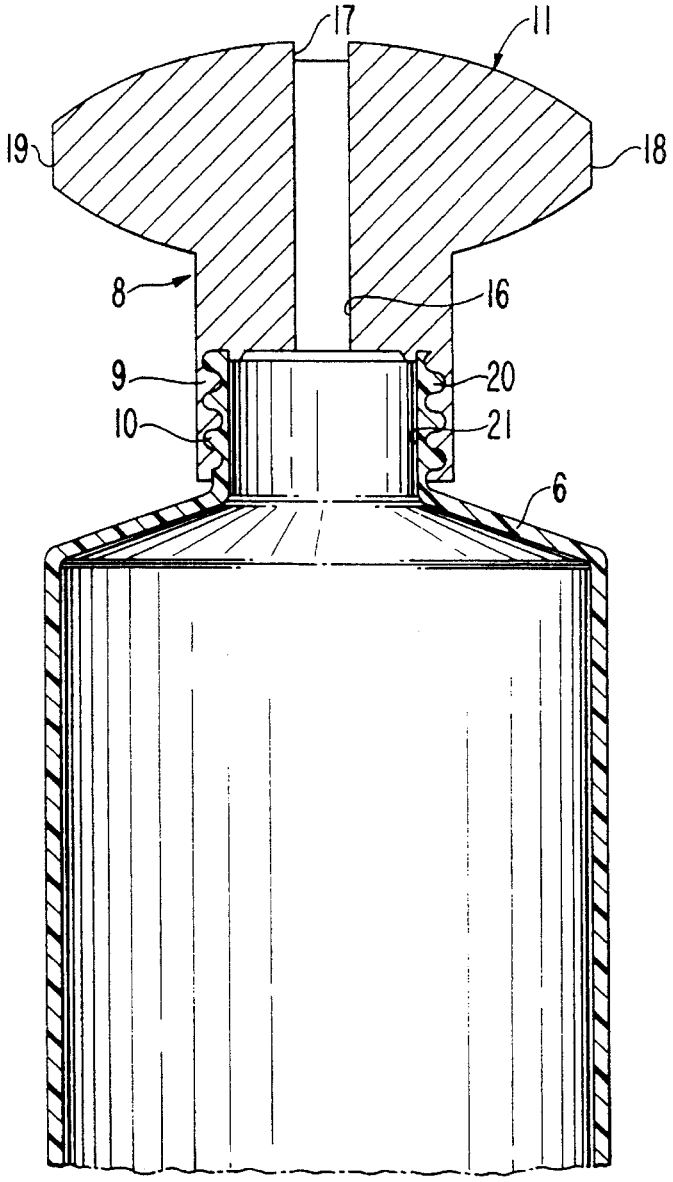
FIG. 3 is a cross-sectional view of a portion of the glue device in FIG. 2.
Figure 5:
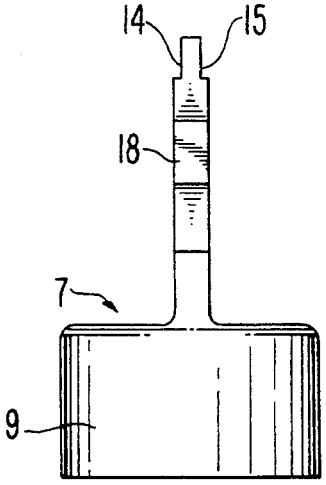
FIG. 5 is a side view of the top of the glue nozzle of the glue device of FIG. 4.
Figure 6:
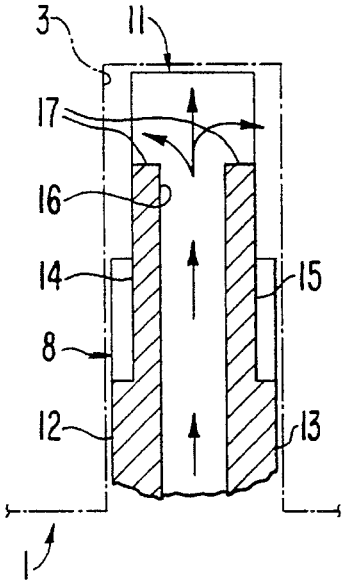
FIG. 6 is a cross-sectional detail view, on an enlarged scale, of the glue nozzle inserted into a groove to be glued, taken along the line VI—VI in FIG. 4.
Figure 4:
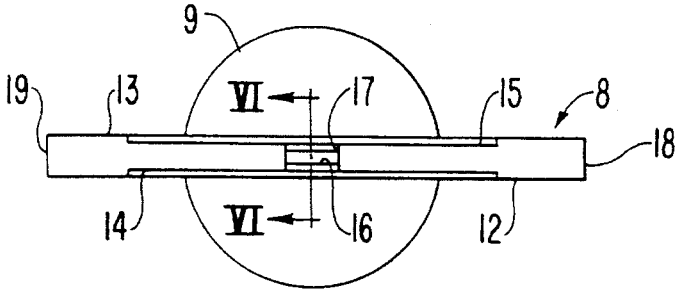
FIG. 4 is a top view of a glue nozzle of the glue device in FIG. 2.
Figure 7:
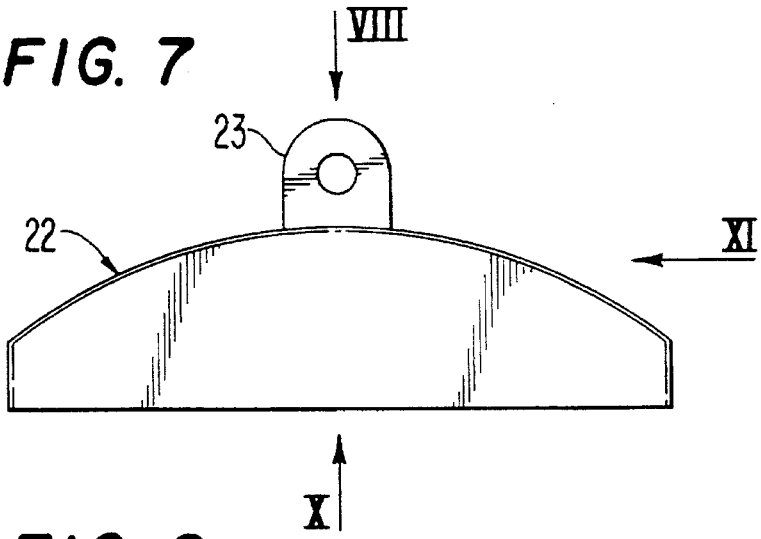
FIG. 7 is a side view of a cap for the mouthpiece of the glue device according to FIG. 2.
Figure 11:
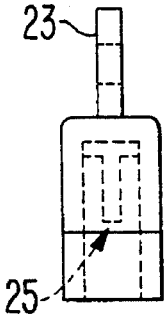
FIG. 11 is a side view taken in the direction of the arrow XI in FIG. 7.
Figure 8:
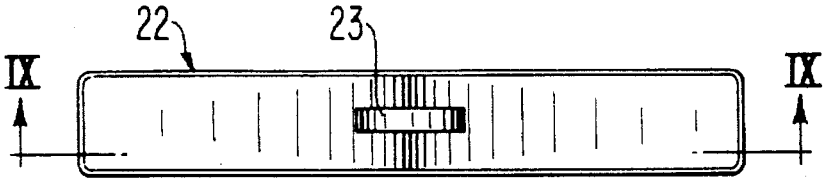
FIG. 8 is a top view taken in the direction of the arrow VIII in FIG. 7.

The section in FIG. 3 shows how the mouthpiece 8, together with a foot made in the form of a screw cap 9, is threaded onto a threaded connecting stub 10 of glue supply container 6. Here the threaded cap 9 is provided with a sealing lip 20 that can be tightened against threaded connecting stub 10. Central glue passageway 16 abuts outlet opening 21 of glue supply container 6, with the passageway terminating before an end 11 of mouthpiece 8 in a transverse groove 17 open to the end 11. The groove connects the two recesses 14 and 15 with one another. The glue distribution within a groove 3 is illustrated by the arrows in FIG. 6.

FIGS. 7–11 show a removable cap 22 belonging to mouthpiece 8. An eye 23 for hanging up the glue device is provided on the top of cap 22. On the inside 24 of cap 22 a stub 25 is provided, so shaped that it is insertable as a sealing element into transverse groove 17 and central glue passageway 15.

Figure 9:
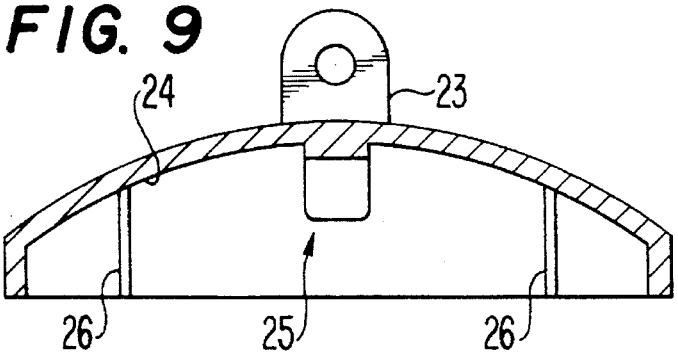
FIG. 9 is a longitudinal cross-sectional view taken along the line IX—IX in FIG. 8.
Figure 10:
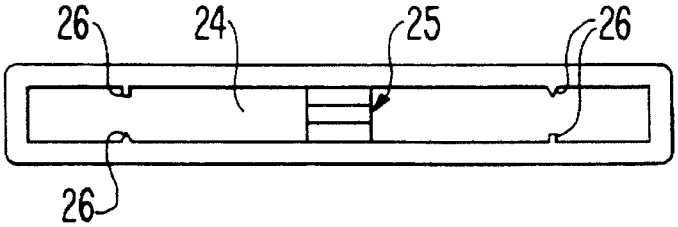
FIG. 10 is a view taken in a direction of the arrow X in FIG. 7.

Cap 22 according to FIGS. 9 and 10 has longitudinally extending ribs 26 on its internal flat sides, with the ribs being separated in the longitudinal direction of the cap by a distance slightly greater than the length of recesses 14 and 15. These longitudinally extending ribs 26 grip wide sides 12 and 13 of mouthpiece 8 tightly and provide a firm seat for cap 22 on mouthpiece 8. They also prevent permanent adhesion of the cap and delimit recesses 14 and 15. The longitudinally extending ribs 26, opposite one another, are designed both slightly square and triangular in cross section, and, in the latter case, one vertex of the triangle is directed at the mouthpiece 8.

I claim:

1. Device for applying glue to slit-shaped grooves of a workpiece, the grooves being dimensioned for respectively receiving a lamellar dowel, wherein the device comprises a glue supply container provided with an outlet opening for dispensing glue, and a glue nozzle located in a vicinity of said outlet opening on the glue supply container said glue nozzle including a rigid flat mouthpiece with a narrow convex end surface portion facing away from said container and two parallel wide sides, said rigid flat mouthpiece being adapted to be inserted into respective slit-shaped grooves, said rigid flat mouthpiece having a central glue passageway opening to the narrow convex end surface portion of said mouthpiece, said mouthpiece is provided at said two parallel wide sides with recesses each opening to said narrow convex top end surface portion, and wherein said central glue passageway, terminates in said narrow convex end surface portion such that glue may dispensed in said recesses whereby a uniform application of glue is provided on side walls and a bottom of the respective grooves so as to ensure a precise metering of the glue in the respective grooves.

2. Device according to claim 1, wherein said mouthpiece is provided on said narrow convex top end surface portion with a transverse groove open to said recesses in which said central glue passageway terminates.

3. Device according to claim 2, wherein said recesses have a length and width such that the recesses are completely insertable into respective slit-shaped grooves, and said parallel wide sides surrounding said recesses, of mouthpiece are separated from one another by a distance equal to width of said slit-shaped grooves.

4. Device according to claim 1, wherein said mouthpiece is provided with a foot in the form of a threaded cap, and wherein said foot is threadable onto a threaded connecting stub of said glue supply container.

5. Device according to claim 4, wherein said threaded foot is provided with a sealing lip adapted to be tightened against said threaded connecting stub.

6. Device according to claim 2, wherein said mouthpiece has a removable cap associated therewith, said cap having, on an interior thereof a stub insertable as a sealing element into a transverse groove and said central glue passageway, and ribs extending in a longitudinal direction of the glue supply container when in the capped position to grip said recesses of said mouthpiece.

7. Device according to claim 1, wherein said glue supply container is fashioned of an elastic plastic material which is manually compressible.

* * * * *